US006016680A

United States Patent [19]

Matsuoka

[11] Patent Number: 6,016,680

[45] Date of Patent: Jan. 25, 2000

[54] SILENT STRUCTURE FOR A DRAWING DIE AND A SILENT RUN-UP UNIT THEREFOR

[75] Inventor: Mitsuo Matsuoka, Neyagawa, Japan

[73] Assignees: JCM Co., Ltd; Umix Co., Ltd., both of Osaka, Japan

[21] Appl. No.: 09/095,757

[22] Filed: Jun. 11, 1998

[51] Int. Cl.[7] ..... B21D 24/12

[52] U.S. Cl. ..... 72/350; 72/417

[58] Field of Search ..... 72/350, 351, 354.8, 72/417

[56] References Cited

U.S. PATENT DOCUMENTS 4,635,466 1/1987 Seki et al. ..... 72/351
5,231,907 8/1993 Matsuoka .

FOREIGN PATENT DOCUMENTS 58-29530 2/1983 Japan ..... 72/417

*Primary Examiner*—Lowell A. Larson

*Attorney, Agent, or Firm*—Birch, Stewart, Kolasch & Birch, LLP

[57] ABSTRACT

A silent structure for a drawing die, includes: a punch, a blank holder vertically movably supported by a cushion pin fitted over the punch, and a die disposed such as to oppose to the punch for moving the die up and down, in which a thin plate lifted by the cushion pin is placed on the blank holder, and the die is lowered to clamp the thin plate by the blank holder and the die, thereby drawing the thin plate, wherein a sub-blank holder is disposed between the cushion pin and the blank holder, a resilient material is interposed between the sub-blank holder and the blank holder, a run-up clearance is provided between the sub-blank holder and the blank holder, a run-up lever is rotatably mounted to the sub-blank holder for pressing the blank holder to allow the blank holder to run up before the die collides against the thin plate on the blank holder, an operation cam for driving the run-up lever is disposed on the die at a location thereof opposed to the run-up lever, and the die collides against the thin plate on the blank holder after the blank holder runs up.

5 Claims, 6 Drawing Sheets

SILENT STRUCTURE FOR A DRAWING DIE AND A SILENT RUN-UP UNIT THEREFOR

BACKGROUND OF THE INVENTION

1. Field of the Invention

The present invention relates to a silent structure for a drawing die and a silent run-up unit therefor used when a plate metal part of an automobile or home electric equipment part is processed by the drawing.

2. Description of the Invention

One example of the drawing die is shown in FIG. 6. This drawing die includes a centrally located punch 101, a blank holder 103 fitted over the punch 101 which is vertically movable supported by a cushion pin 102, and a die 104 disposed to oppose to the punch 101 for vertical movement.

A lower die 109 comprising the punch 101 and the blank holder 103 is secured to a bolster 106 of a press machine. An upper die 110 comprising the die 104 is secured to a ram 107 of the press machine, and moves up and down when the press machine is driven. Further, the blank holder 103 is supported by the cushion pin 102. A cushion apparatus of the press machine moves the cushion pin 102 up and down, and the blank holder 103 moves up and down accordingly.

The drawing will be explained. First, the blank holder 103 is lifted by the cushion pin 102 up to a position shown by a phantom line.

Next, the thin plate 108 is placed on the blank holder 103 and the punch 101 as shown by a phantom line.

Thereafter, when the upper die 110 is lowered, the die 104 collides against the thin plate 108 on the blank holder 103 over the entire outer periphery of the punch 101, and the blank holder 103 and the die 104 sandwich the thin plate 108. Subsequently, when the upper die 110 is lowered, the thin plate 108 sandwiched between the blank holder 103 and the die 104 is drawn, and when the upper die 110 reaches the illustrated bottom dead center, the thin plate 108 is drawn into a work area W.

When the upper die 110 is lifted, the blank holder 103 is lifted up to the position shown by the phantom line by a rising force of the cushion pin 102, and the plate in the work area W is released from the punch 101. The die 104 in the upper die 110 is provided with an air vent 105 for preventing a negative pressure from being created between, the plate in the work area W and the die 104 when the plate in the work area W falls by its own weight. Or the plate in the work area W is moved downward and released out from the die 104 by a pushing pin (not shown) biased by a spring, and the plate in the work area W released out by a press machine is sent to that for a next process.

In the above described drawing, when the die 104 collides against the thin plate 108 placed on the blank holder 103, the die 104 collides against the thin plate 108 over the entire outer periphery of the punch 101 simultaneously, and a pressure applied to the cushion pin 102 may reach about 60 to 100 tons, which causes a large noise. In these days when a quiet environment is required, the noise of the drawing die is a serious social problem.

In order to prevent the noise generated when the die collides against the thin plate on the blank holder of the drawing die, an attempt has been made to reduce the noise by providing an urethane rubber or gas spring on the blank holder so that die collides against the urethane rubber or gas spring before the die collides against the thin plate on the blank holder to absorb the shock, but sufficient noise reduction could not be obtained.

Further, an attempt has been made to lower the cushion pressure for only a constant time period at an initial stage of the lowering movement of the cushion pin when the die collides against the thin plate on the blank holder, but it is necessary to improve the cushion apparatus of the press machine, which substantially inflates costs.

In the drawing die, a substantial amount of noise is generated when the die collides against the thin plate on the blank holder, and it is required to reduce the noise as much as possible.

SUMMARY OF THE INVENTION

Thereupon, in view of the above circumstances, the present invention provides a silent structure for a drawing die, comprising: a punch; a blank holder vertically movably supported by a cushion pin fitted over the punch; and a die disposed such as to oppose to the punch for moving the die up and down, in which a thin plate is placed on the blank holder lifted by the cushion pin. The die is lowered to clamp the thin plate by the blank holder and t thereby drawing the thin plate, wherein a sub-blank holder is disposed between the cushion pin and the blank holder. A resilient material is interposed between the sub-blank holder and the blank holder while a run-up clearance is provided between the sub-blank holder and the blank holder. A run-up lever is rotatably mounted to the sub-blank holder for pressing the blank holder to allow the blank holder to run up before the die collides against the thin plate on the blank holder; an operation cam for driving the run-up lever is disposed on the die at a location thereof opposed to the run-up lever, and the die collides against the thin plate on the blank holder after the blank holder runs up.

Further, according to the invention, the operating cam includes a cam surface having an inclination angle for varying speed.

Further, according to the invention, in order to make it easy to improve the existing drawing die to a silent structured drawing die, there is provided a silent run-up unit mounted to the sub-blank holder and the die, and the silent run-up unit collides against the sub-blank holder after the blank holder runs up.

Further, according to the invention, in order to make it easy to improve the existing drawing die to a silent structured drawing die, there is provided a silent run-up unit further comprising a run-up lever and an operating cam for driving the run-up lever.

Furthermore, according to the invention, in order to lower noise of a pad of the upper die, the lower die is provided with an operating cam, and the upper die is provided at its portion opposed to the operating cam with a run-up lever.

Further, according to the invention, there is provided a press die which sandwiches a thin plate in a work area for processing the latter, wherein the thin plate in a work area is sandwiched after run-up by a silent unit. Therefore, silence in the press die is obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

DETAILED DESCRIPTION OF THE PREFERRED EMBODIMENTS

The present invention will be described in detail below based on a specific embodiment shown in the accompanying drawings.

Figure 1:
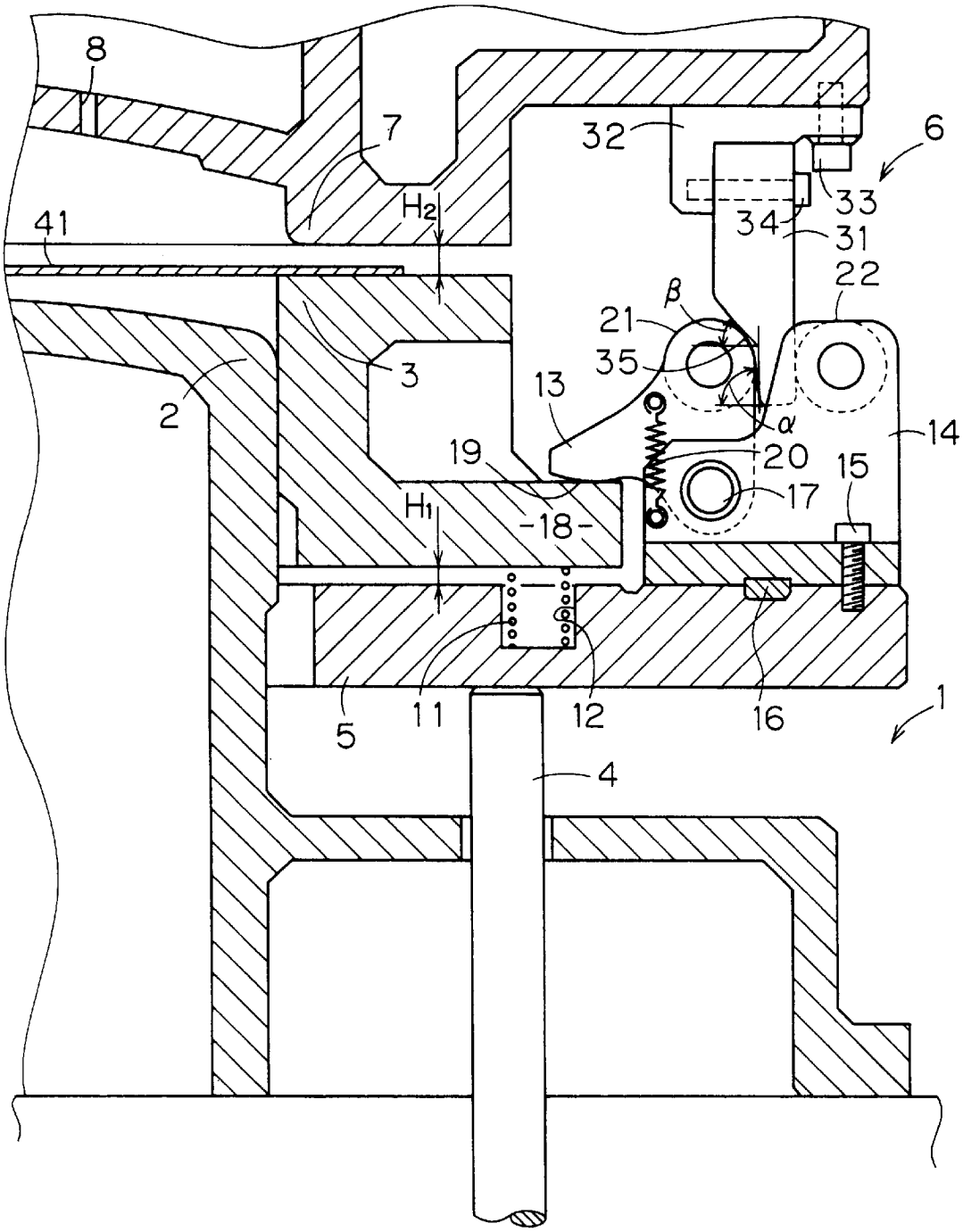
FIG. 1 is a longitudinal sectional view of an essential portion showing a state in which a run-up lever of the present invention starts operation.

Referring to FIG.1, a lower die 1 comprises a punch 2, a blank holder 3 vertically movably fitted over the punch 2, and a sub-blank holder 5 supported by a cushion pin 4 below the blank holder 3 fitted over the punch 2.

An upper die 6 comprises a die 7 disposed to oppose to the punch 2.

A spring 11 is interposed between the sub-blank holder 5 and the blank holder 3 of the lower die 1 so that the blank holder 3 floats up from the sub-blank holder 5 to provide a clearance therebetween. Here, this clearance is called a run-up clearance $H_1$. The spring 11 is inserted into a support hole 12 recessed in an upper surface of the sub-blank holder 5. Although a spring is used here as an example, any element may be used if it is a resilient material such as urethane rubber and which supports the blank holder, and can be compressed when a pressure is applied, and can be restored when the pressure is released.

A substantially triangular run-up lever 13 is rotatably mounted to a bracket 14 for pressing the blank holder 3 to make it run up. The bracket 14 is secured to the sub-blank holder 5 by a bolt 15, and a key 16 is provided so that a mounting position of the sub-holder 5 can accurately be determined.

There is provided a silent run-up unit which is mounted to the sub-blank holder 5 and the die 7 and which makes the blank holder 3 run up and collide against the sub-blank holder 5. One example of the silent run-up unit is illustrated.

The run-up lever 13 is rotatably provided around a rotating shaft 17 mounted to the bracket 14 for pressing a flange 18 of the blank holder 3. A tensile spring 20 is provided between the run-up lever 13 and the bracket 14 so that a pressing surface 19 of the run-up lever 13 is always abutted against the flange 18.

A roller 21 is rotatably provided on an upper portion of the run-up lever 13, and another roller 22 is rotatably provided at a location opposed to the roller 21 of the bracket 14.

An operation cam 31 is provided at a location of the die 7 opposed to the rollers 21 and 22. The operation cam 31 is mounted to the die 7 through the supporting mount 32. The supporting mount 32 is secured to the die 7 by a bolt 33, and the operation cam 31 is secured to the supporting mount 32 by a bolt 34. The operation cam 31 and the supporting mount 32 may be integrally formed as a single element The operating cam 31 has a cam surface 35 which is formed with a low speed incline angle $\alpha$ close to a right angle at its portion which contacts with the roller 21 at an initial stage of the lowering movement of the upper die 6, and is formed with an intermediate speed incline angle $\beta$ which is continuous with the low speed incline angle $\alpha$ The low speed incline angle $\alpha$ and the intermediate speed incline angle $\beta$ are smoothly connected with each other such as to form an arc shape. The lowering speeds of the run-up lever 13 and the blank holder 3 can be controlled by varying the low speed incline angle $\alpha$ and the intermediate speed incline angle $\beta$ of the operation cam 31.

Although the above described silent run-up unit has the run-up lever 13 and the operation cam 31, the present invention should not be limited only to this type of unit, and another type of unit suffices if it can be mounted to the sub-blank holder and the die, and has a mechanism to make the blank holder run up and then make it collide against the sub-blank holder. For example, in such a silent run-up unit, a lowering rod may be secured to the die, and the lowering rod may make the blank holder run up.

An operation of the embodiment will be described next.

The thin plate 41 mounted on the punch 2 and the blank holder 3.

FIG. 1 shows a state where the upper die 6 is lowered, and the run-up lever 13 starts abutting against the flange 18 of the blank holder 3 by the operation cam 31. An operation starting clearance $H_2$ between the blank holder 3 and the die 7 in FIG. 1 is set greater than the run-up clearance $H_1$ in order to make the blank holder 3 collide against the sub-blank holder 5 after the run-up of the blank holder 3. A relationship between the run-up clearance $H_1$ and the operation starting clearance $H_2$ (a difference of the operation starting clearance $H_2$ over the run-up clearance $H_1$) is set such that a sufficient silent operation can be obtained.

Figure 2:
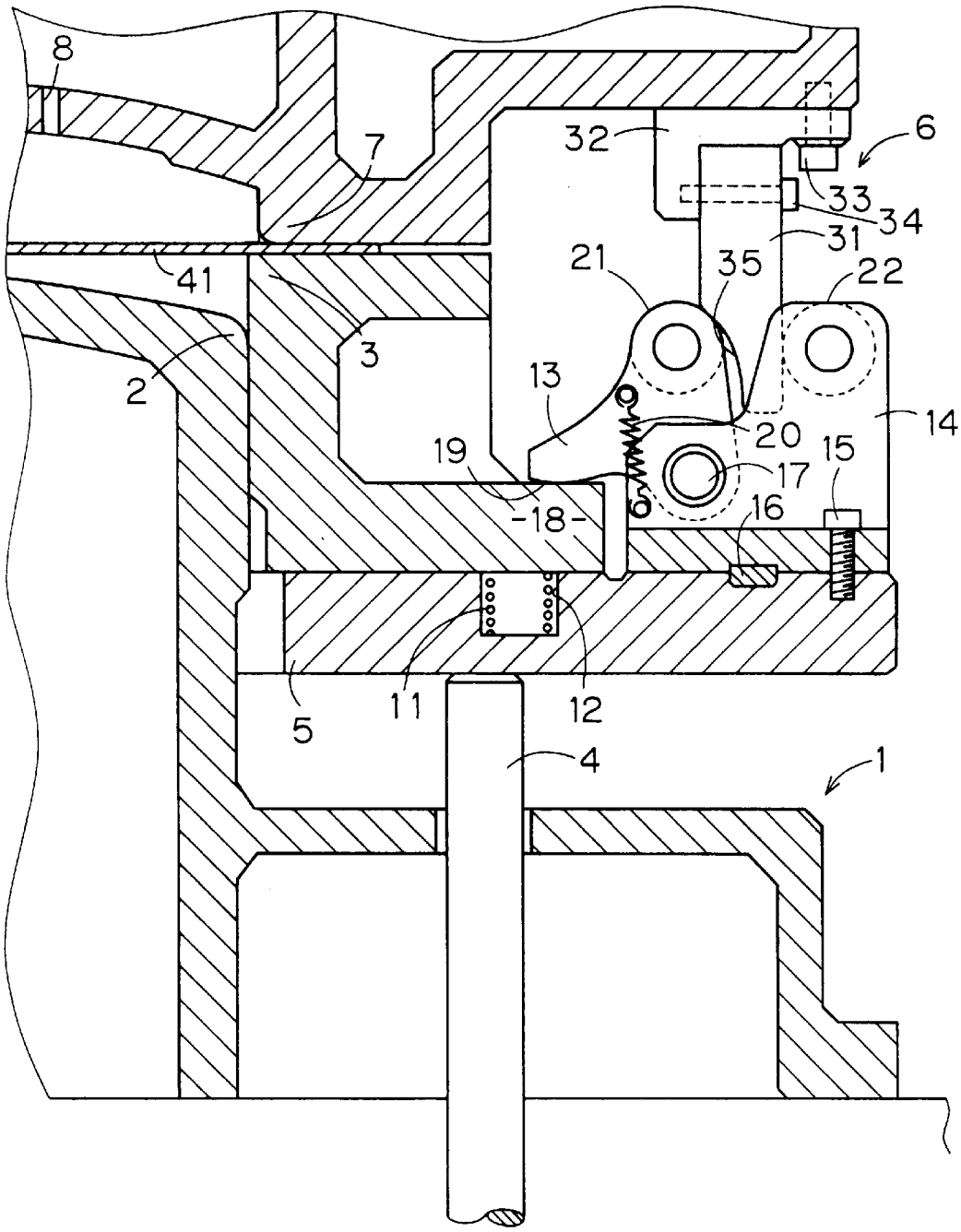
FIG. 2 is a longitudinal sectional view of an essential portion showing a state in which a blank holder of the invention runs up, and a die collides against a thin plate on the blank holder after the blank holder abuts against a sub-blank holder.

When the blank holder 3 runs up by the run-up lever 13, the spring 11 is compressed and a lower surface of the blank holder 3 abuts against an upper surface of the sub-blank holder 5 and then, a thin plate 41 of the blank holder 3 abuts against the die 7. Such state is shown in FIG. 2. The die 7 abuts against the running up thin plate 41 of blank holder 3 rather than the stationary blank holder 3. That is, the die 7 does not collide against the stationary thin plate 41, but collides against the running up thin plate 41 and therefore, noise is substantially reduced.

Figure 3:
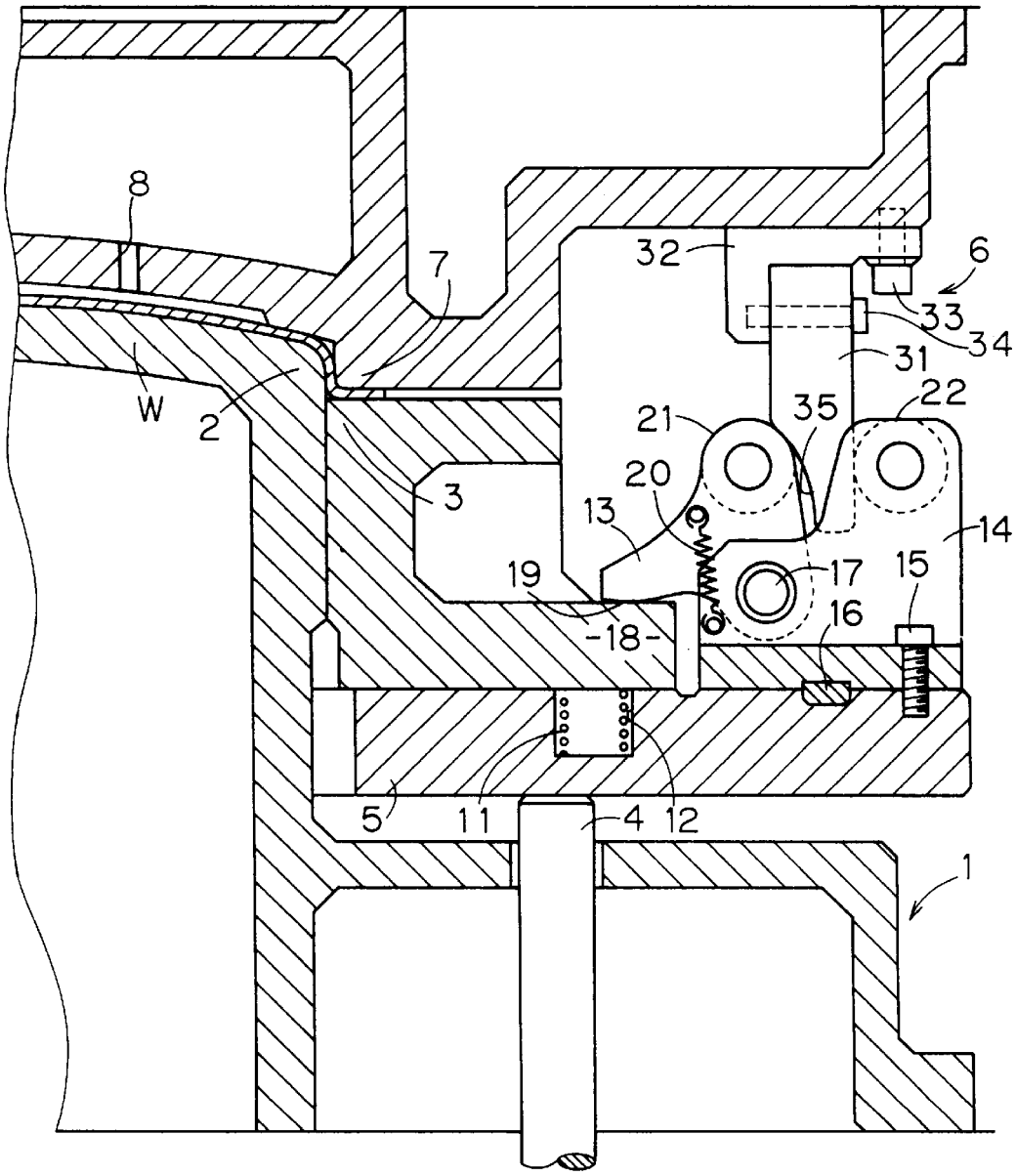
FIG. 3 is a longitudinal sectional view of an essential portion showing a state of a bottom dead center in which an upper die is lowered from the state shown in FIG. 2, and the drawing is completed.

Thereafter, the upper die 6 keeps lowering, and a drawing is completed at the bottom dead center shown in FIG. 3, and a work area W is formed.

When the upper die 6 moves up, the plate in the work area W is released from the punch 2 by the blank holder 3. The die 7 is provided with an air vent 8 so that a negative pressure is prevented from being created between the plate in the work area W and the die 7 when the plate in the work area W falls by its own weight. Alternatively, the plate in work area W is released out from the die 7 by a pushing pin (not shown) biased by a spring.

Figure 4:
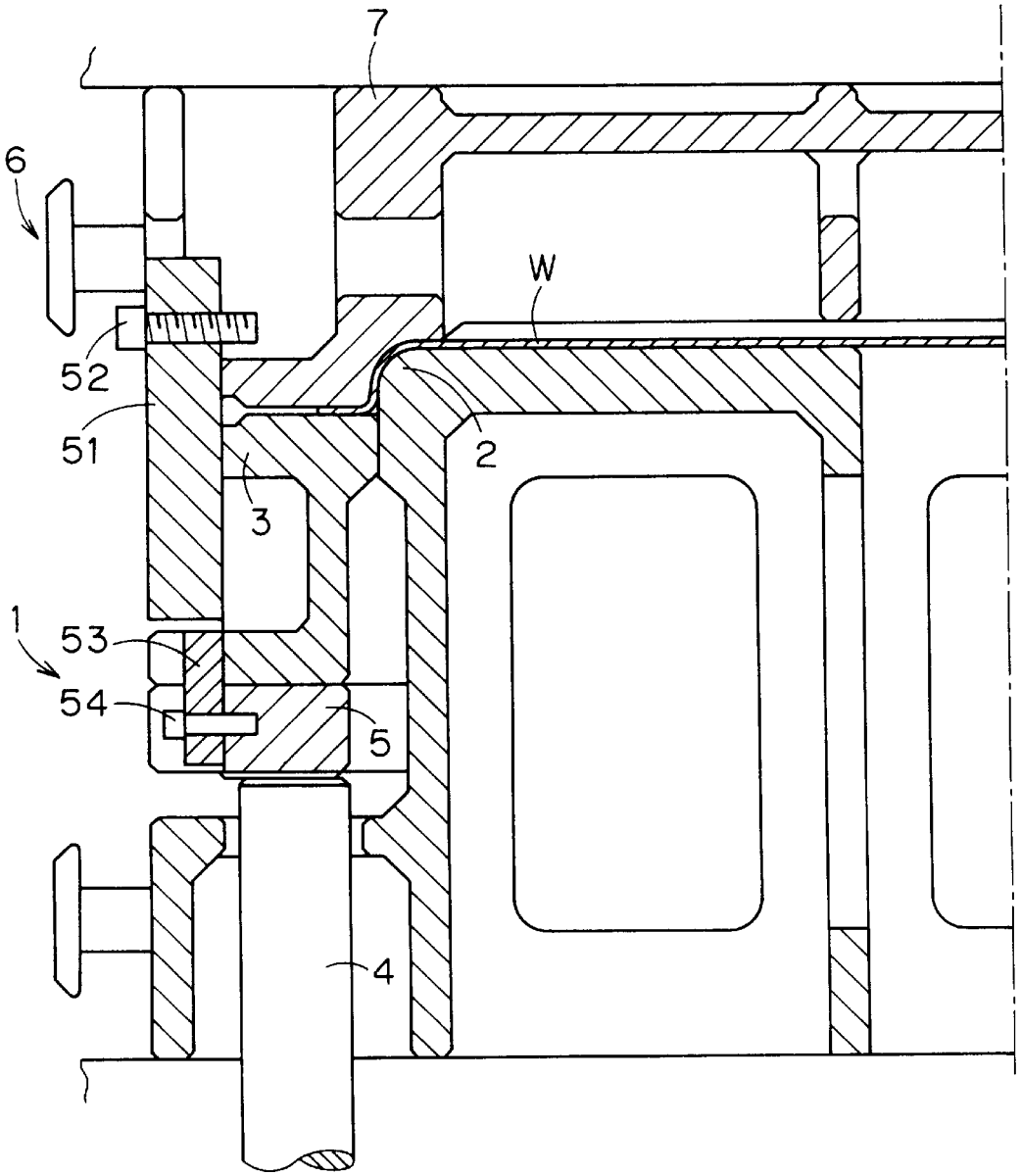
FIG. 4 is a longitudinal sectional view showing a state of the bottom dead center of the drawing die of the present invention, and a state in which a guide plate is positioning the sub-blank holder.

FIG. 4 shows a second embodiment where a guide plate 51 is mounted to the die 7 by a bolt 52. The guide plate 51 allows the blank holder 3 to slide, thereby positioning the blank holder 3.

A guide post 53 is mounted to the sub-blank holder 5 by a bolt 54. The guide plate 51 allows the blank holder 3 to slide, thereby positioning the sub-blank holder 5.

If various sized run-up levers 13, brackets 14, operating cams 31 (including rollers 21, 22, rotating shafts 17, tension springs 20 and supporting mounts 32) are prepared as conforming parts, it is possible to easily change the existing drawing die structure to a silent structure.

If a urethane sheet is spread over the lower surface of the blank holder 3 or the upper surface of the sub-blank holder 5, the noise reduction is further enhanced.

Figure 5:
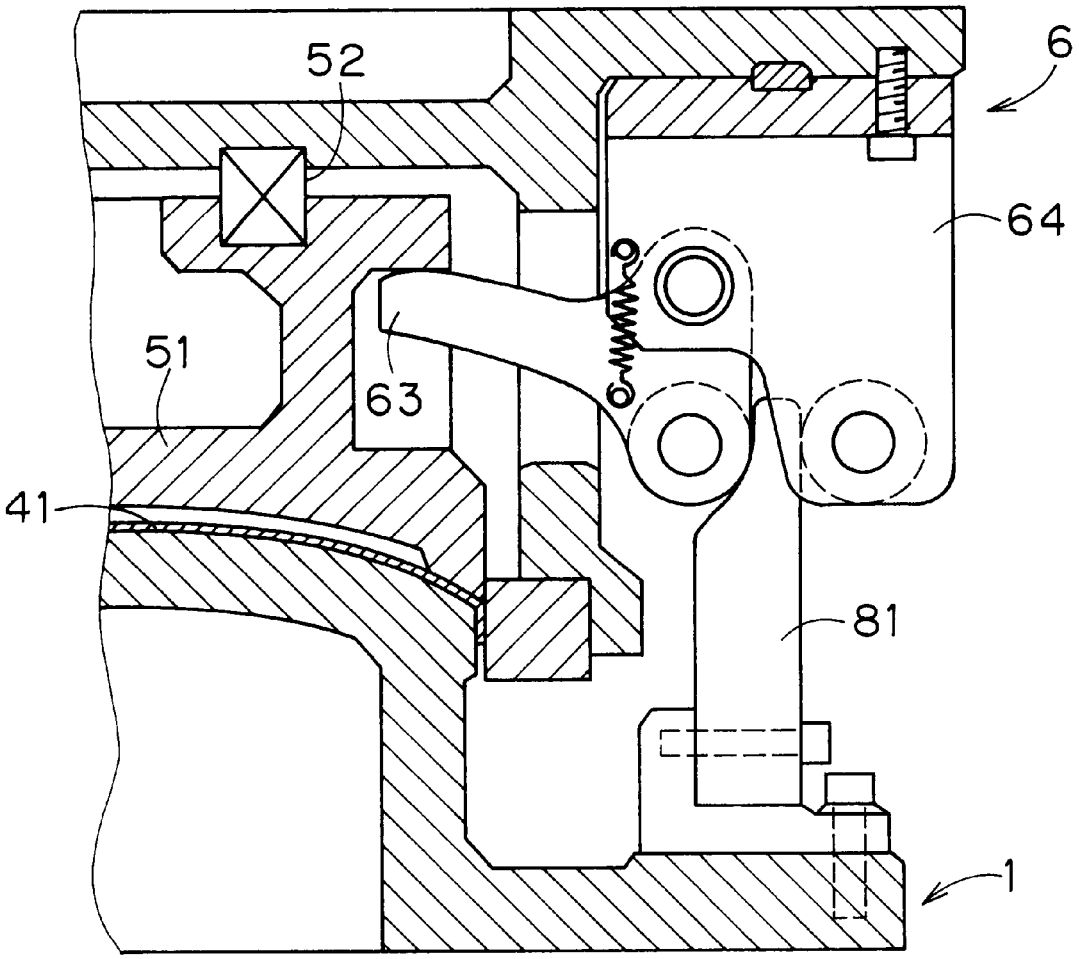
FIG. 5 is a longitudinal sectional view of a press die having lower and upper dies, the lower die includes the operating cam, and the upper die includes the run-up lever and the bracket.
Figure 6:
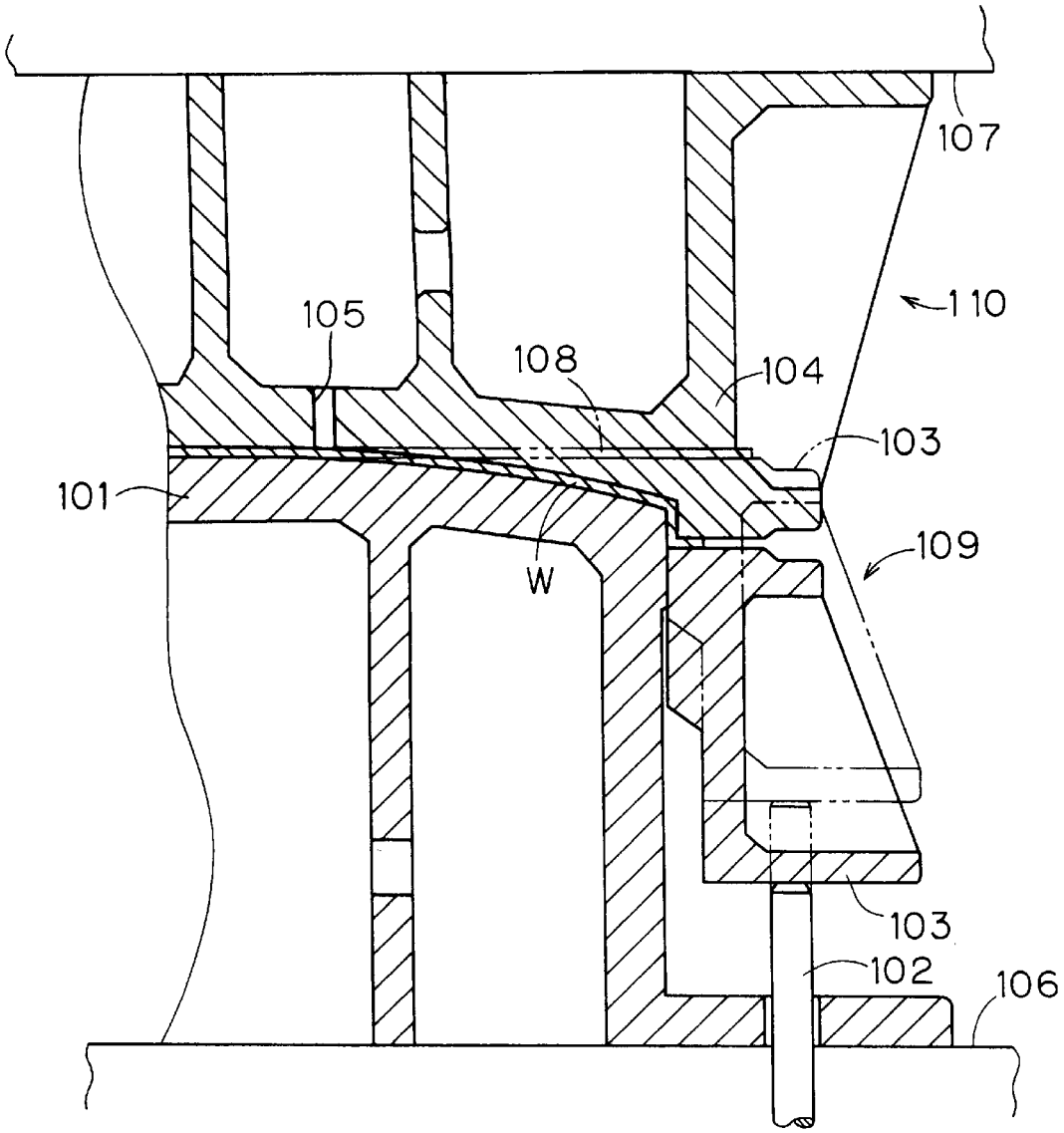
FIG. 6 is a longitudinal sectional view of a conventional drawing die.

Although there has been described above that the run-up lever 13 and the bracket 14 are mounted to the lower die 1, and the operating cam 31 is mounted to the upper 6, show in FIG. 5 of a third embodiment of the invention, even if the run-up lever 63 and the bracket 64 are mounted to the upper die 6, and the operating cam 81 is mounted to the lower die 1, similar noise reduction can be obtained. In this case, although the pad 51 is biased by the spring 52, since the pad 51 collides against the thin plate 41 after the pad 51 runs up by the run-up lever 63 and the operating cam 81, noise reduction can be obtained.

Further, according to the present invention, when the thin plate is bent, or one end of the thin plate is bent downward and the other end is bent upward, the noise reduction can be obtained if the thin plate in the work area is made to run up and then clamped.

As described above, according to the present invention, the silent structure for a drawing die, comprises: a punch; a blank holder vertically movably supported by a cushion pin fitted over the punch; and a die disposed to oppose the punch for moving the die up and down, in which a thin plate lifted by the cushion pin is placed on the blank holder. The die is lowered to clamp the thin plate by the blank holder and the die draws the thin plate. The wherein-a sub-blank holder is disposed between the cushion pin and the blank holder, while a resilient material is interposed between the sub-blank holder and the blank holder. A run-up clearance is provided between the sub-blank holder and the blank holder, and a run-up lever is rotatably mounted to the sub-blank holder for pressing the blank holder to allow the blank holder to run up before the die collides against the thin plate on the blank holder. An operation cam for driving the run-up lever is disposed on the die at a location thereof opposed to the run-up lever. The die collides against the thin plate on the blank holder after the blank holder runs up. Since the die collides against the thin plate on the blank holder after the blank holder runs up, it is possible to substantially reduce noise as compared with a case where the die collides against a stationary blank holder. Further, the present invention can be used as an improved silent structure for an existing drawing die by endplaying a unitery run-up lever and rotating cam.

Further, by varying the inclination angle of the cam surface of the operating cam, a speed of run-up of the blank holder can be controlled.

Furthermore, the silent run-up unit is mounted to the sub-blank holder and the die, and the silent run-up unit collides against the sub-blank holder after the blank holder runs up. Therefore, it is easy to improve the existing silent structure for the drawing die.

Further, the silent run-up unit comprises a run-up lever and an operating cam for driving the run-up lever. Therefore, it is easy to improve the existing silent structure for the drawing die.

According to another embodiment of the present invention, the silent structure includes lower and upper dies, and the lower die is provided with an operating cam, and the upper die is provided at its portion opposed to the operating cam with a run-up lever.

Therefore, a noise resulting from a pad of the upper die can be substantially lowered.

According to the present invention, in a press die which sandwiches a thin plate in a work area for processing, since the thin plate in the work area is sandwiched after run-up by a noise unit, silence in the press die can be substantially reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A silent die structure for drawing a plate comprising:

a stationary punch;

a cushion pin disposed in said stationary punch;

a blank holder movably supported by said cushion pin and disposed adjacent to said stationary punch;

a moveable die disposed adjacent to and opposing said stationary punch;

a sub-blank holder disposed between said cushion pin and said blank holder;

means for biasing said blank holder relative to said sub-blank holder;

a run-up lever rotatably mounted to said sub-blank holder for pressing said blank holder towards said sub-blank holder prior to said moveable die contacting the plate disposed on said blank holder; and an operation cam driving said run-up lever being disposed on said moveable die at a location opposing said run-up lever, whereby a magnitude of noise generated when said moveable die contacts the plate, said blank holder, and said stationary punch is substantially reduced.

2. The silent die structure of claim 1, wherein said operating cam includes a cam surface having an inclination angle for varying a speed of movement of said run-up lever and said blank holder.

3. The silent die structure of claim 1, further comprising a guide plate mounted to said moveable die, said guide plate slidingly engages with said sub-blank holder and allows positioning thereof.

4. The silent die structure of claim 3, further comprising a guide post mounted to said sub-blank holder.

5. The silent die structure of claim 3, wherein said guide plate is mounted to said die by a bolt.

* * * * *